US007350332B2

(12) United States Patent
Petridis et al.

(10) Patent No.: US 7,350,332 B2
(45) Date of Patent: Apr. 1, 2008

(54) WALL-MOUNTED SLIDING DOOR SYSTEM AND METHOD

(75) Inventors: Georgios Petridis, Amaliada (GR); Jason M. Walsh, Batavia, IL (US)

(73) Assignee: Masonite Corporation, Tampa, FL (US)

( * ) Notice: Subject to any disclaimer, the term of this patent is extended or adjusted under 35 U.S.C. 154(b) by 409 days.

(21) Appl. No.: 10/891,453

(22) Filed: Jul. 15, 2004

(65) Prior Publication Data

US 2006/0011311 A1 Jan. 19, 2006

(51) Int. Cl.
*E05F 17/00* (2006.01)

(52) U.S. Cl. ..... 49/122; 49/116; 49/370

(58) Field of Classification Search ..... 160/196.1; 116/87 R, 90, 94 R, 94 D, 95 R, 96 R, 97, 116/99, 100, 102, 106; 49/73.1, 120, 116, 49/370, 409, 103, 105, 95, 96, 122, 138, 49/358, 360

See application file for complete search history.

(56) References Cited

U.S. PATENT DOCUMENTS 1,023,723 A * 4/1912 Cossey ..... 49/116
1,294,169 A * 2/1919 Roberts ..... 49/116
1,881,016 A * 10/1932 Rose ..... 49/118
2,303,263 A * 11/1942 Fisher ..... 310/14
2,871,009 A * 1/1959 Picatti ..... 49/30
4,424,605 A * 1/1984 Squires et al. ..... 16/94 R
4,672,773 A * 6/1987 Bilt ..... 49/358
5,301,994 A * 4/1994 Wilson ..... 296/97.2
5,483,769 A * 1/1996 Zweili ..... 49/118
5,845,363 A * 12/1998 Brempell et al. ..... 16/105
2002/0125735 A1* 9/2002 Rogers et al. ..... 296/155
2004/0068835 A1* 4/2004 Satterfield ..... 16/94 R

* cited by examiner

*Primary Examiner*—Brian E. Glessner
*Assistant Examiner*—Candace L. Bradford
(74) *Attorney, Agent, or Firm*—Berenato, White & Stavish, LLC

(57) ABSTRACT

A sliding wall-mounted interior door system that includes a telescoping door actuating mechanism that is attached to the upper portion of the door, and a roller assembly that extends horizontally from the wall and engages a track in the lower portion of the door. The door actuating system is designed so that the movement of one of the door panels simultaneously moves the other door panel in the opposite direction. The actuating mechanism is designed so that a gearing assembly within the actuating mechanism moves laterally when the door system is moved between the open and closed positions.

32 Claims, 9 Drawing Sheets

WALL-MOUNTED SLIDING DOOR SYSTEM AND METHOD

FIELD OF THE INVENTION

The invention generally relates to doors used in dwellings. Specifically, the invention relates to wall-mounted sliding interior doors having a top-hung actuating mechanism that causes the doors to move cooperatively.

BACKGROUND OF THE INVENTION

A typical interior door is comprised of a rectangular door hung by at least two hinges to a doorframe. The door pivots about the hinges to swing between the open and closed positions and thereby allow or prevent entry or departure from a room. Although conventional doors are well known, they have significant disadvantages. Sufficient area must exist in front of the door so that the door can swing outwardly. This limitation may reduce the available floor space in a room, or require that the door be opened into a traffic area. Double entry doors are also known, which require yet more space.

The prior art also includes a variety of sliding doors. The prior art sliding doors generally slide on a track at the top or the base of the doors. The most common sliding doors are comprised of a transparent material, such as glass, and are used as exterior not have the space requirements of conventional hinged doors, pocket doors require a door track disposed above and/or below the door that extends twice the length of the door opening. Because of a pocket door's installed position within an interior wall, the doors are relatively expensive to install and may be difficult to repair if the sliding hardware associated with the door breaks or malfunctions after installation. Further, the disposition of the pocket door also makes it difficult to replace the door if an occupant wishes to redecorate a room or relocate the wall opening.

Additionally, both conventional hinged doors and conventional sliding doors are manufactured to specific sizes to accommodate standard-sized door openings. Since both types of conventional doors are manufactured to fit within the specific standard-sized openings, the size and shape of the doors are limited by the size and shape of the door openings. Also, manufactures must stock additional inventory to accommodate the various sizes, further increasing costs.

The need exists for an innovative door system that is not limited to standard-sized door openings, and that incorporates an actuation mechanism that is easily accessible for repair, or the replacement of the door panels. The invention discloses a wall-mounted sliding door that can be used with a range of door opening sizes. The door slides adjacent to the wall and thereby maximizes the space available within a room. The door does not require a lengthy floor or ceiling-mounted track that may become damaged or obstructed. The door actuating mechanism also allows the door system door panels to be easily replaced if an occupant intends to redecorate a room.

SUMMARY OF THE INVENTION

The invention comprises a sliding two-panel door system. The door system includes a telescoping door actuating mechanism that is disposed on a wall above the door opening. The actuating mechanism has at least two rails and a gearing assembly that rotatably connects to the two rails.

Each of the rails is attached to one of the two door panels. When either one of the door panels is moved laterally, the gearing assembly also moves laterally. The door system is moved between the closed and open positions by moving one of the panels in a first direction and thereby causing the gearing assembly to propel the other door panel in the opposite direction.

The invention further comprises a two-panel door system with a telescoping door actuating mechanism mounted above a door opening. The two door panels may have a non-rectangular shape. The actuating mechanism includes at least a top rail and an intermediate rail with a gearing assembly interconnecting the top rail with the intermediate rail. The upper portion of the first door panel is attached to the top rail and the upper portion of the second door is attached to the intermediate rail. When one of the door panels moves laterally, the gearing assembly also moves laterally. The gearing assembly has a 2:1 gear ratio. The door system also includes rollers positioned on each side of the door opening. The rollers extend horizontally and engage a roller track positioned on the bottom portion of each of the door panels. The rollers provide additional vertical support for the door system and facilitate the lateral movement of the door panels. The door system is moved between the closed and open positions by moving one of the panels in a first direction thereby causing the gearing assembly to propel the other door panel in the opposite direction.

The invention also comprises a sliding interior door apparatus for a door opening in a wall comprising a telescoping door actuating mechanism extending above a door opening and attaching to a wall. The upper portions of the first and second door panels are attached to the door actuating mechanism. The door system also includes first and second rollers positioned on each side of the door opening. The rollers extend horizontally and engage first and second roller tracks positioned in a slot on the bottom portion of each of the door panels. The rollers provide additional vertical support for the door system and facilitate the lateral movement of the door panels. The door system is moved from a closed position to an open position by applying a force to one of the door panels. When a force is applied to the first door panel then the first door panel moves in a first direction away from the second door panel so that the actuating mechanism telescopes in the first direction to allow the first door panel to slide away for the centerline of the door opening in the first direction. The door actuating system simultaneously telescopes in a direction opposite the first direction and propels the second door panel in the opposite direction of the first door panel so that the door system is moved to the open position and the door opening is uncovered.

The invention further comprises a method of operating sliding doors. Two sliding door panels ate attached to two sliding rails. A gearing assembly interconnects the sliding rails. A motive force is applied to a selected door panel, thereby moving the selected door panel laterally and causing the gearing assembly to also move laterally. The gearing assembly simultaneously directs the force to the non-selected door panel so that the non-selected door panel moves in the opposite direction of the selected door panel and thereby causes the selected and non-selected door panels to move in opposite directions. The movement of the door panels in opposite directions allows the door panels to diverge and converge and thereby causes the door to move between open and closed positions.

DETAILED DESCRIPTION OF THE PREFERRED EMBODIMENTS

Figure 1:
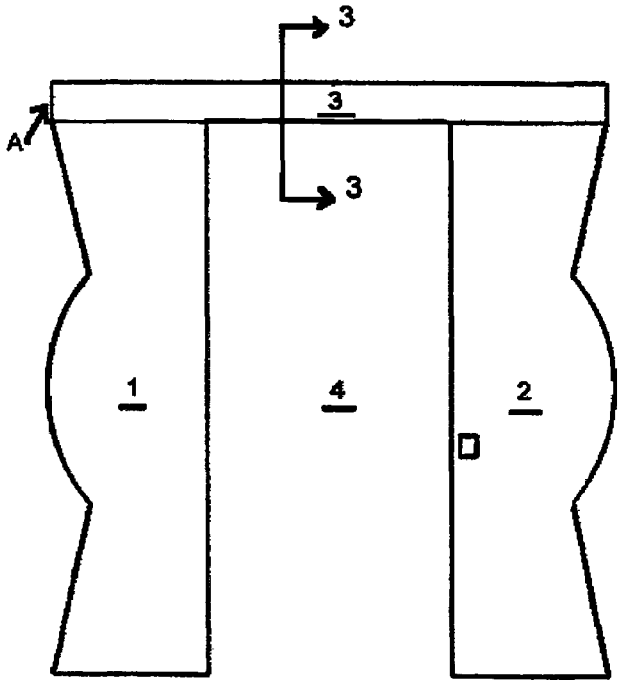
FIG. 1 is an elevational front view of the door system of the present invention in the open position.
Figure 2:
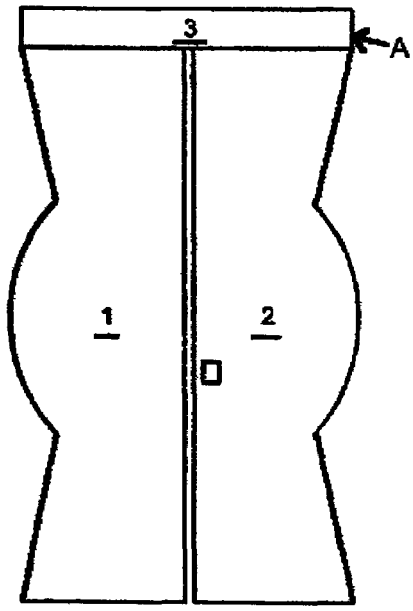
FIG. 2 is an elevational front view of the door system in the closed position.

As best shown in FIGS. 1-2, the current invention is a two-panel wall-mounted sliding door system. FIG. 1 shows the doors in the open position permitting passage through the opening in a wall, and FIG. 2 shows the doors in the closed position. The invention is comprised of first 1 and second 2 sliding door panels extending vertically downwardly from a telescoping door actuation mechanism A to the floor.

The door actuating mechanism A includes a decorative cover 3 that is disposed on the outside of the actuating mechanism A. As best shown in FIG. 1, the cover 3 is extendable to accommodate the expanded area spanned by the door panels 1, 2 in the open position. When the door panels 1, 2 move to the closed position of FIG. 2, the cover 3 retracts to accommodate the retracted door actuating mechanism A. The cover may be comprised of a stretchable fabric that simply stretches and retracts when the door opens and closes, or it may be comprised of other materials such as leather, non-stretchable fabric, plastic, wood, metal, a composite material, or the like, either alone or in combination with a stretchable fabric. The cover may expand and contract in a telescoping or accordion manner, or by any other means known in the art.

As best shown in FIGS. 3*a*-3*d*, various configurations of horizontal support structures are used to support to the door system, stabilize the bottom portion of the door panels, and facilitate the lateral movement of the door panels 1, 2. In the preferred embodiment shown in FIG. 3*a*, a roller assembly 8 extends horizontally from the wall 6 and engages a roller track 10 in the bottom portion of each of the door panels 1, 2. The roller assembly 8 may be comprised of at least a circular roller attached to the end of a roller support. The roller track 10 is positioned either within the bottom portion of the door, or alternatively the roller track may extend horizontally from the bottom portion of the door. The specific structure of the roller assembly 8 may include any rolling or sliding mechanism known in the art that vertically supports the door panels 1, 2 and facilitates the lateral sliding motion of the door panels 1, 2. The roller assembly 8 and roller track 10 maintain vertical alignment of the door panels 1, 2 parallel to wall 6.

Figure 3A:
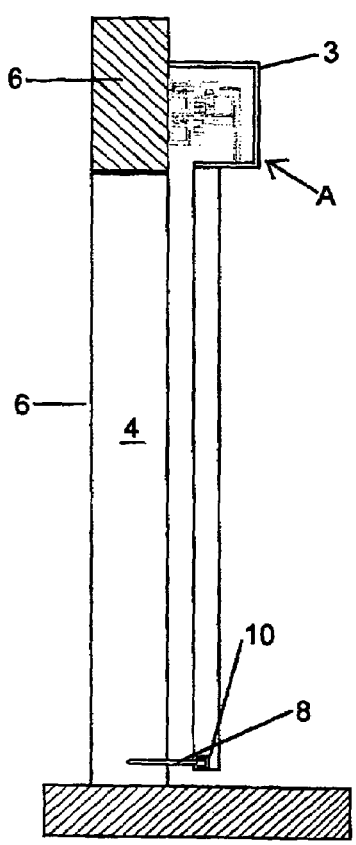
FIGS. 3*a*-3*d* are cross-sectional views of various embodiments taken along the line 3-3 shown in FIG. 1 and looking in the direction of the arrows.
Figure 3B:
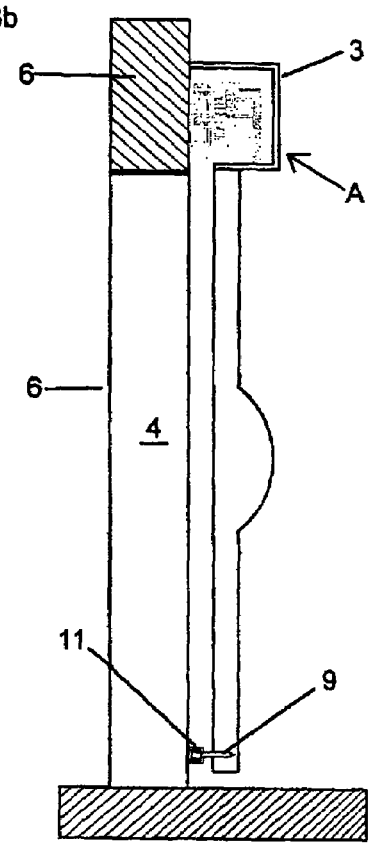
Figure 3C:
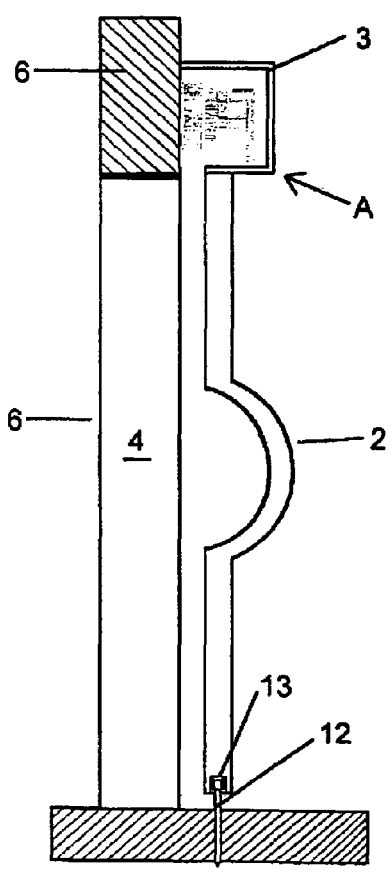
Figure 3D:
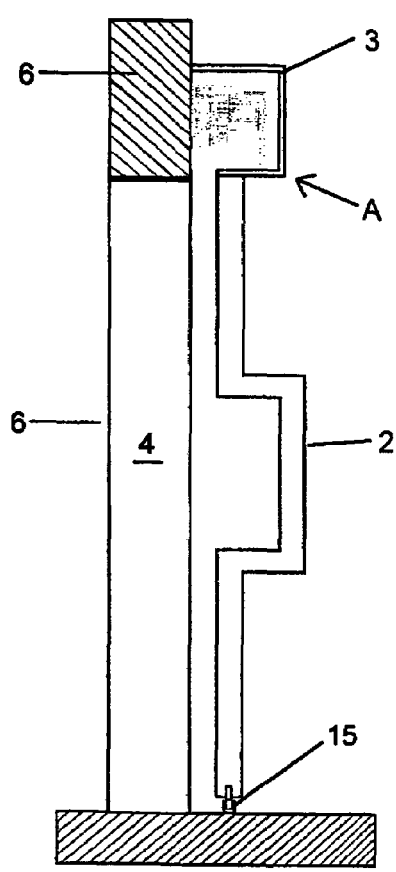

In an alternative embodiment of the horizontal support structure described above, a door-mounted roller assembly 9 extends horizontally from the bottom portion of each of the door panels 1, 2 and engages a wall-mounted roller track 11 positioned on the wall 6, as best shown in FIG. 3*b*. In an additional alternative embodiment best shown in FIG. 3*c*, a floor-mounted roller assembly 12 extends upwardly so that the roller assembly 12 engages a roller track 13 positioned on the bottom of the door panels 1, 2. In the alternative embodiment shown in FIG. 3*d*, the roller track has been removed so that a roller assembly 15 extends vertically downward from a bottom portion of the door panels 1, 2 and engages the floor. In yet an additional embodiment, the support assembly hardware may be removed so that the door panels 1, 2 are supported solely by the door actuating mechanism A attached to the upper portion of the door panels 1, 2.

Figure 4:
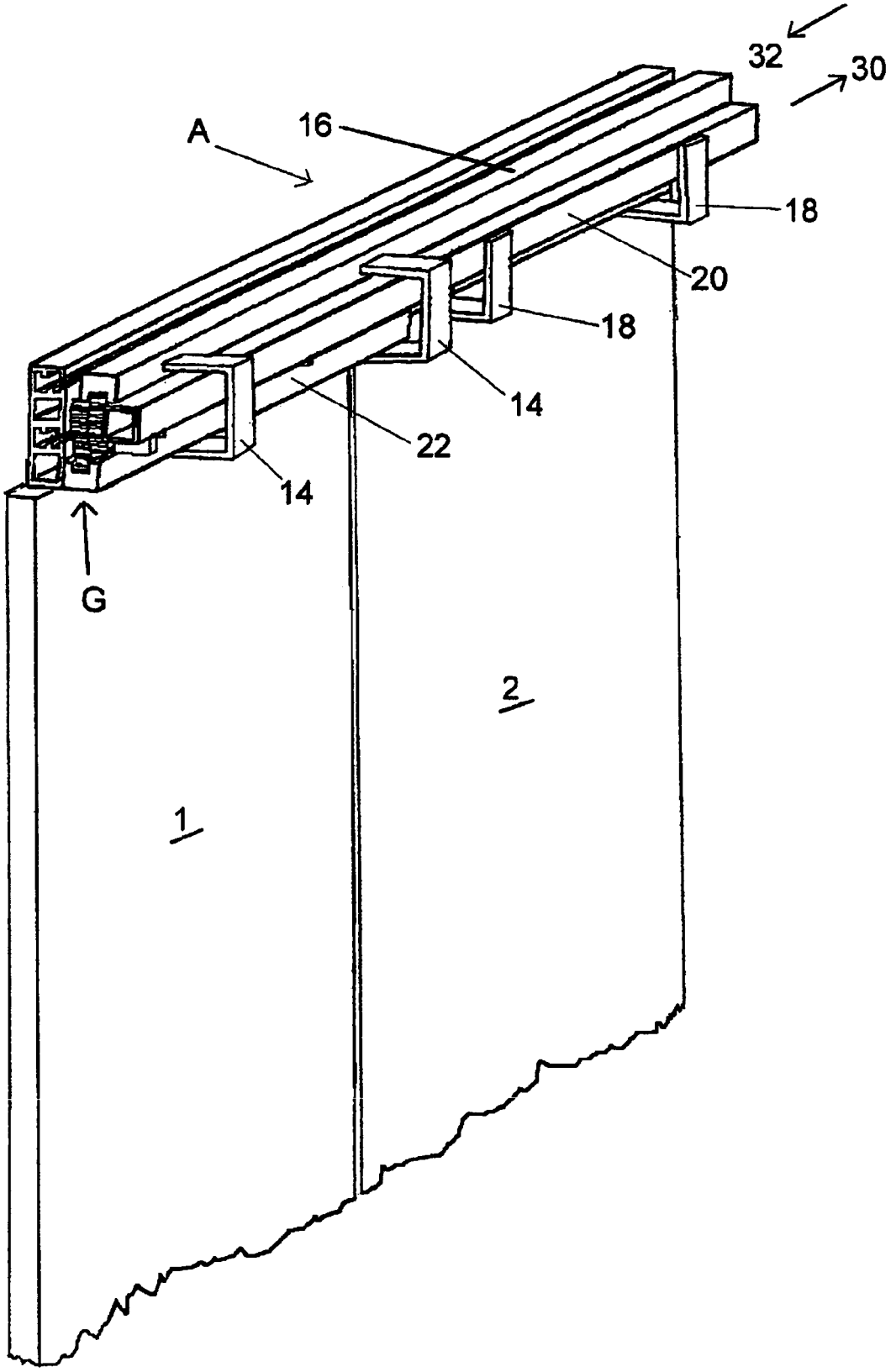
FIG. 4 is a fragmentary perspective view of the present invention with the cover for the door actuation mechanism removed.

As best shown in FIGS. 1-4, because the door panels 1, 2 are mounted in front of the door opening 4, rather than within the opening 4, the size, shape, and configuration of the panels 1, 2 are not limited by the dimensions or shape of the door opening 4. This aspect of the invention gives an occupant of a dwelling much greater flexibility in determining the size, and shape of the door panels 1, 2. The door panels 1, 2 may be rectangular as shown in FIG. 4, or non-rectangular as shown in FIGS. 1 and 2. Similarly, the panels 1, 2 may be planar as shown in FIG. 3*a*, or non-planar as shown in FIGS. 3*b* and 3*c*. As best shown in FIG. 3*b*, the panels 1, 2 may have one side that is planar and one side that is non-planar, or both sides may be non-planar, as best shown in FIGS. 3*c* and 3*d*. Additional variations and combinations of the above door panel configurations should be considered within the scope of the invention.

The flexibility of the door system described above is further enhanced because, with the decorative cover 3 removed, the door actuating mechanism A is fully exposed thereby allowing the easy removal and replacement of the door panels 1, 2 during a renovation or redecorating process. Access to the door panels 1, 2 allows an occupant to change the shape, size, style or colors of the door panels as a room is redecorated or the furniture is replaced. This increased flexibility allows the door system to become a variable aspect of the room furnishings rather than a fixed and non-variable component.

As best shown in FIG. 4, the actuating mechanism A includes top brackets 14 that extend from a top railing 16 to the first door panel 1, and intermediate brackets 18 that extend from an intermediate rail 20 to the second door panel 2. A gearing assembly G interconnects the top rail 16 with the intermediate rail 20 and stationary rail 22. The brackets 14, 18 extend downwardly and then back under the actuating mechanism A so that the door panels extend vertically beneath the actuating mechanism A.

Figure 5:
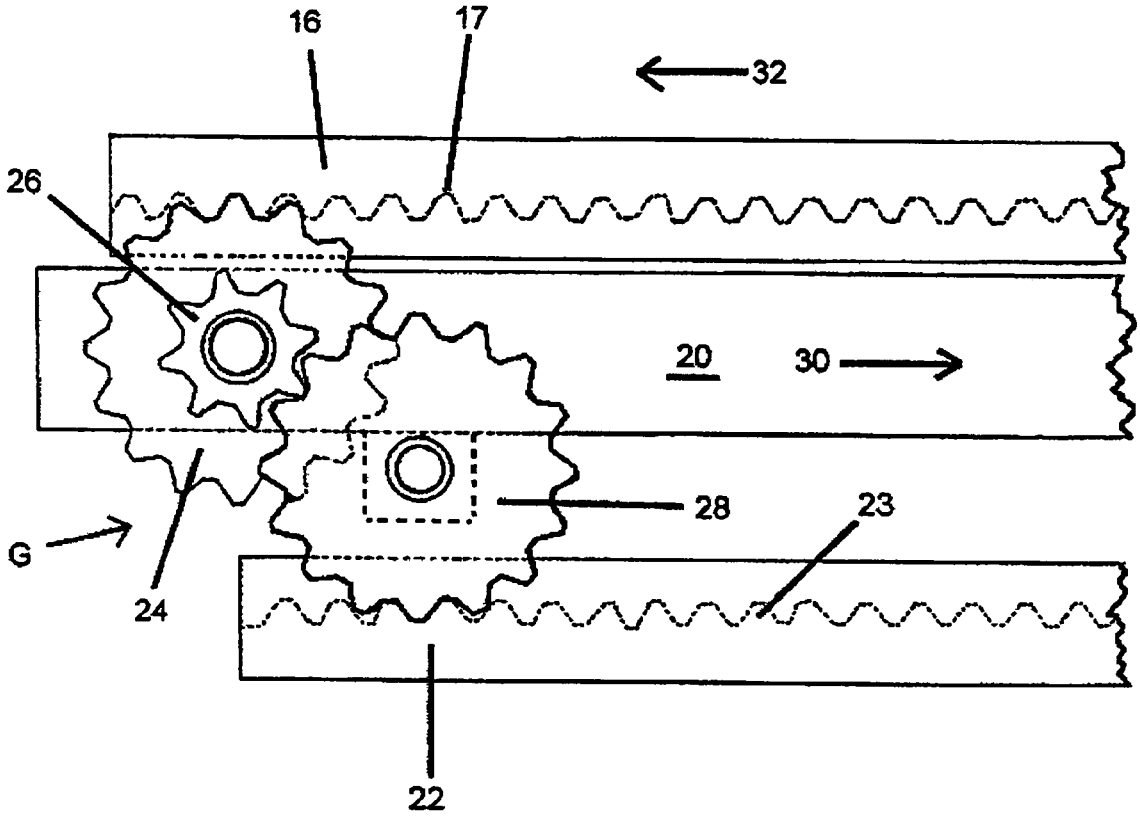
FIG. 5 is a fragmentary elevational view of the gearing assembly of the invention.

As best shown in FIG. 5, the gearing assembly G is comprised of a first gear 24 that meshes with gear teeth 17 on the top rail 16. A second gear 26 extends outwardly from the center portion of the first gear 24 and meshes with a third gear 28. In the preferred embodiment, the second gear 26 has half the diameter of the first 24 and third 28 gears so that the gearing assembly G has a gearing ratio of 2:1, i.e. the first gear 24 rotates at twice the rate of the third gear 28 when the gearing system G is engaged. The third gear 28 meshes with the teeth 23 of the stationary rail 22. All three gears 24, 26, 28 of the gearing assembly G are connected to the intermediate rail 20 so that when the intermediate rail moves from left to right in FIG. 5, the gearing assembly G also moves from left the right. While a 2:1 gearing ratio is preferred, other gearing ratios are potentially usable.

As best shown in FIGS. 4 and 5, to open the door panels 1, 2, a force is applied to the first 1 or second 2 door panel to move one of the door panels 1, 2 in the opposite direction of the other door panel. If the force is applied to the second door panel 2, the force is communicated through the intermediate brackets 18 attached to the second door panel 2 to the intermediate rail 20. As the second door panel 2 and attached intermediate rail 20 move away from the first door panel 1, the intermediate rail 20 also moves the gearing assembly G in the same direction, as indicated by the arrows 30 in FIGS. 4 and 5.

As best shown in FIG. 5, as the gearing assembly G moves in the direction of the arrow 30, the third gear 28 engages the teeth on the stationary rail 22, which imparts a clockwise rotational force to the third gear 28. The rotary force generated by the third gear 28 communicates through the second gear 26 to the first gear 24 so that the first 24 and second 26 gears rotate in a counter-clockwise direction. The first gear 24 engages the teeth 17 on the top rail 16 and imparts a horizontal force to the top rail 16 in the direction indicated by the arrow 32. As a result of the gearing between the second 26 and third 28 gears, the counter-clockwise rotation of the first gear 24 propels the top rail 16 and attached first door panel 1 in a direction opposite of the movement of the intermediated rail 20.

The 2:1 gear ratio of the gearing assembly G is required to move the first door panel 1 in the opposite direction of the second door panel 2 at the same horizontal speed as the second door panel 2. As described above, the second door panel 2, gearing assembly G, and intermediate rail 20 are all directly connected and move together. As the gearing assembly G and associated components move (to the right in FIGS. 4 and 5 during the opening process), the movement causes the gearing assembly G to rotate the first gear 24 in the opposite direction of the third gear 28 at twice the rate of the third gear 28. The rotation of the first gear 24 imparts a horizontal force to the top rail 16 and causes first door panel 1 to move to the left away from the door opening 4 centerline even as the first gear 24 and the rest of the gearing assembly 26, 28 move to the right. The 2:1 gear ratio allows the top rail 16 and attached first door panel 1 to move in the opposite direction of the gearing assembly G and attached second door panel 2 at the same horizontal speed as the second door panel 2, and thereby allows the first door panel 1 to reach the fully open (or closed) position at the same time that the second panel 2 reaches the corresponding position.

Figure 6:
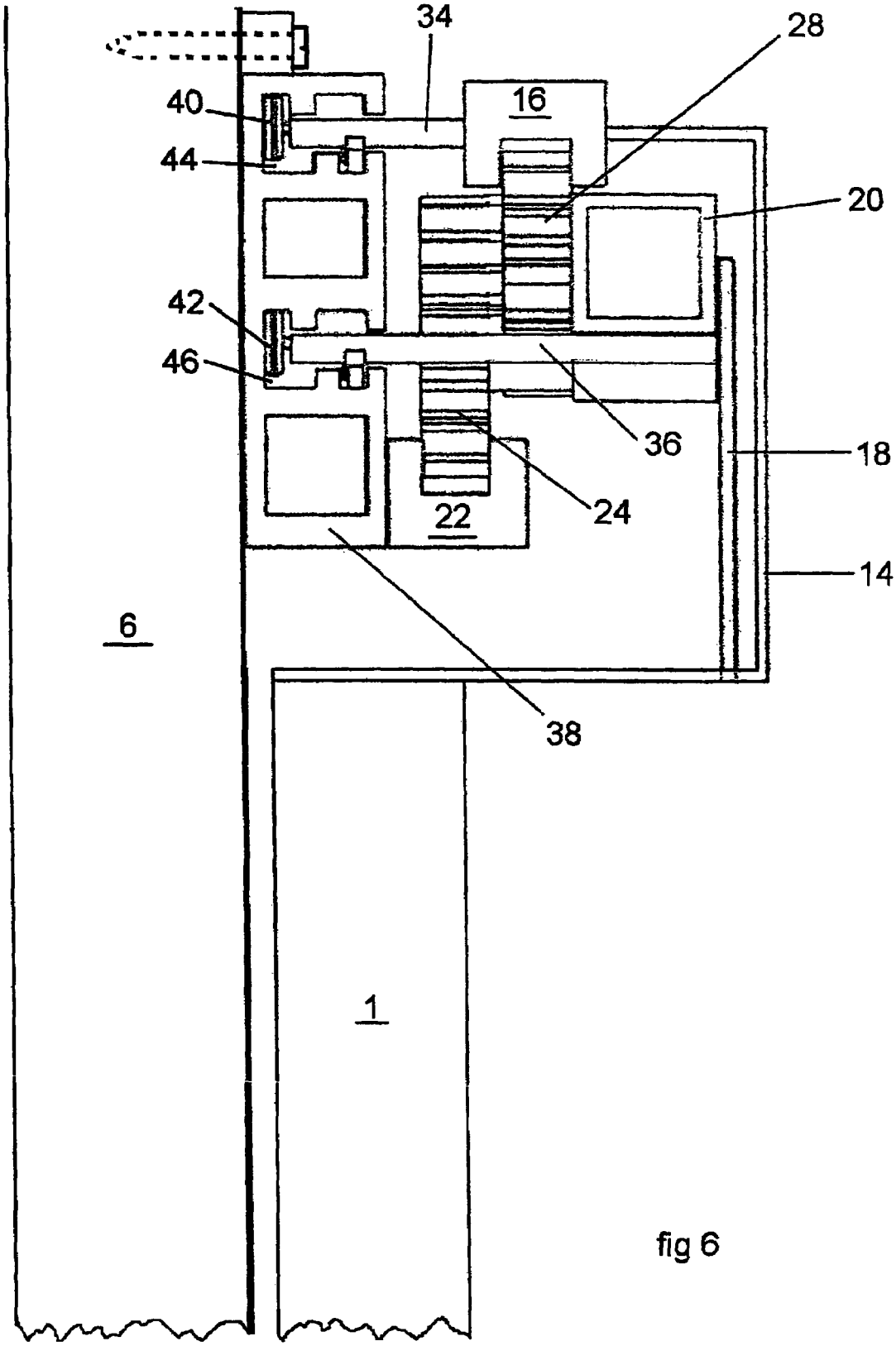
FIG. 6 is a fragmentary elevational view of the door actuating mechanism mounted on the wall with the cover removed.

As best shown in FIG. 6, the top rail 16 and the intermediate rail 20 are attached to top 34 and intermediate 36 lateral supports, respectively. The top 34 and intermediate 36 lateral supports extend horizontally between the rails 16, 20 and a primary base unit 38, which may be attached to the wall 6 by suitable mechanical fasteners. Roller assemblies 40, 42 are rotatably connected to the ends of the top 34 and intermediate 36 supports. The roller assemblies 40, 42 travel in roller tracks 44, 46 disposed within the primary base unit 38 and provide support for the rails 16, 20. Both the top 16 and intermediate 20 rails have at least one lateral support 34, 36 extending between the primary base unit 38 and each of the rails 16, 20.

Figure 7:
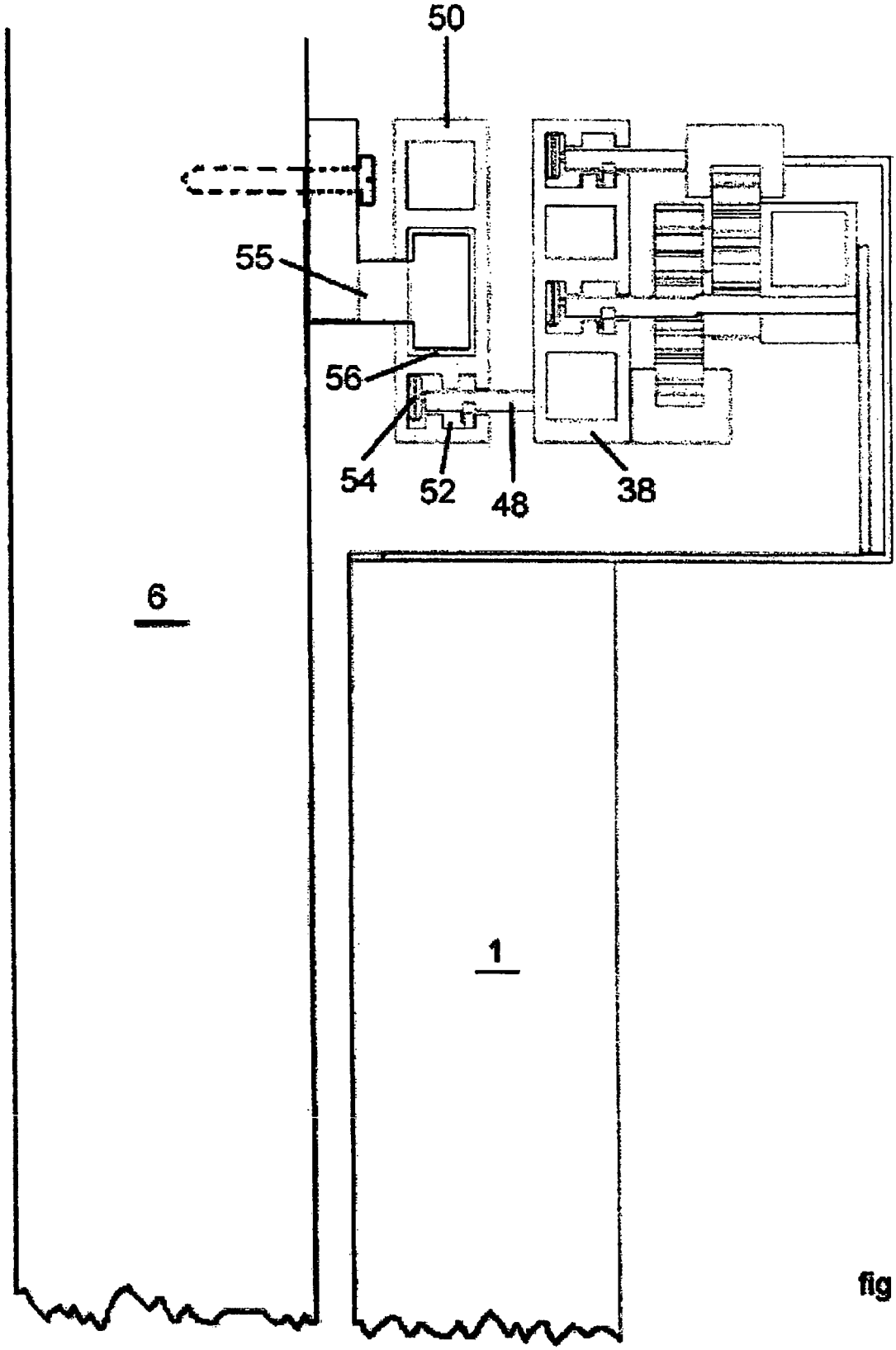
FIG. 7 is a fragmentary elevational view of an alternative embodiment of the door actuating mechanism mounted on the wall with the cover removed.
Figure 8:
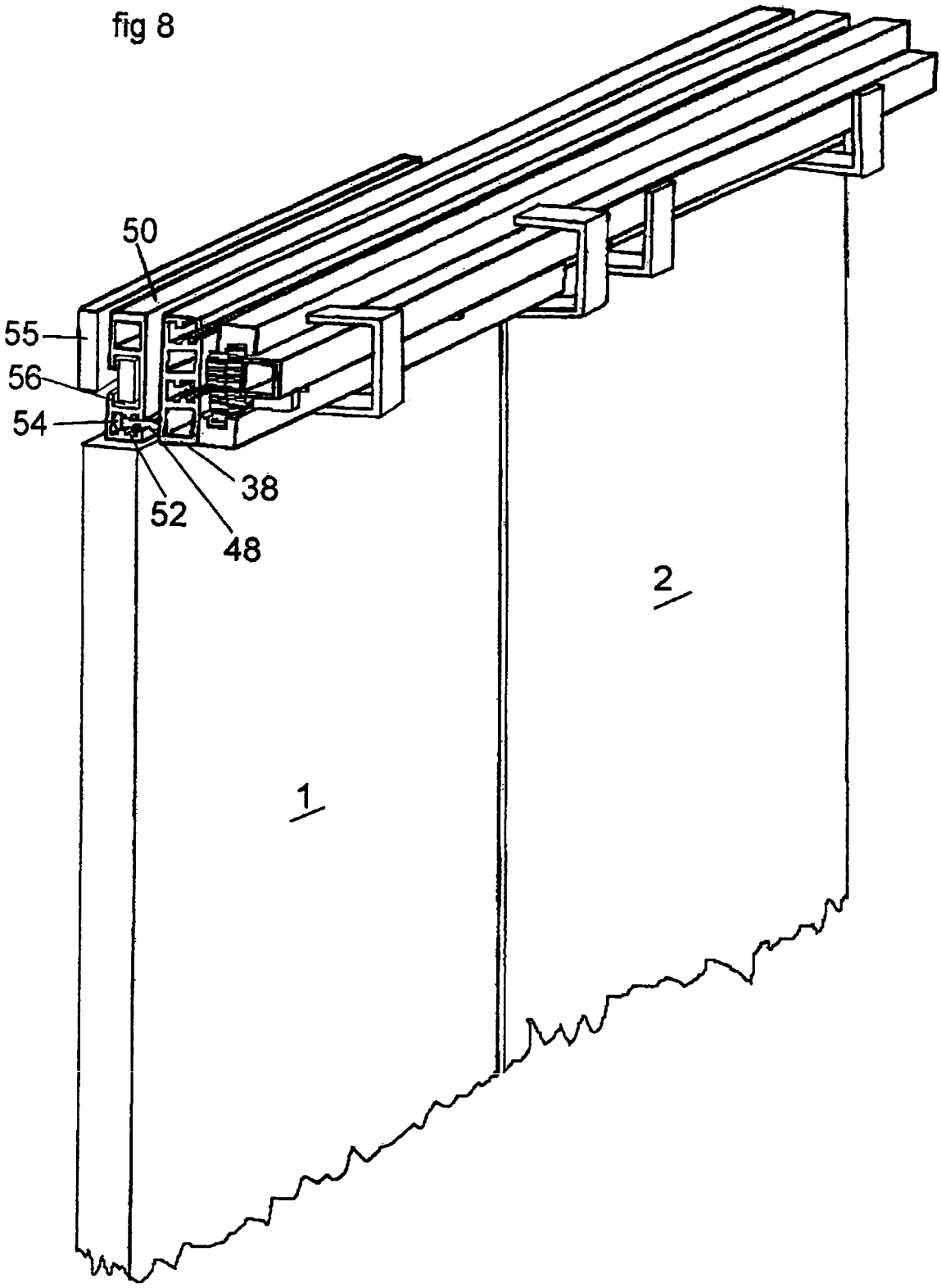
FIG. 8 is a fragmentary perspective view partially in section of the alternative embodiment shown in FIG. 7 with the cover removed.
Figure 9:
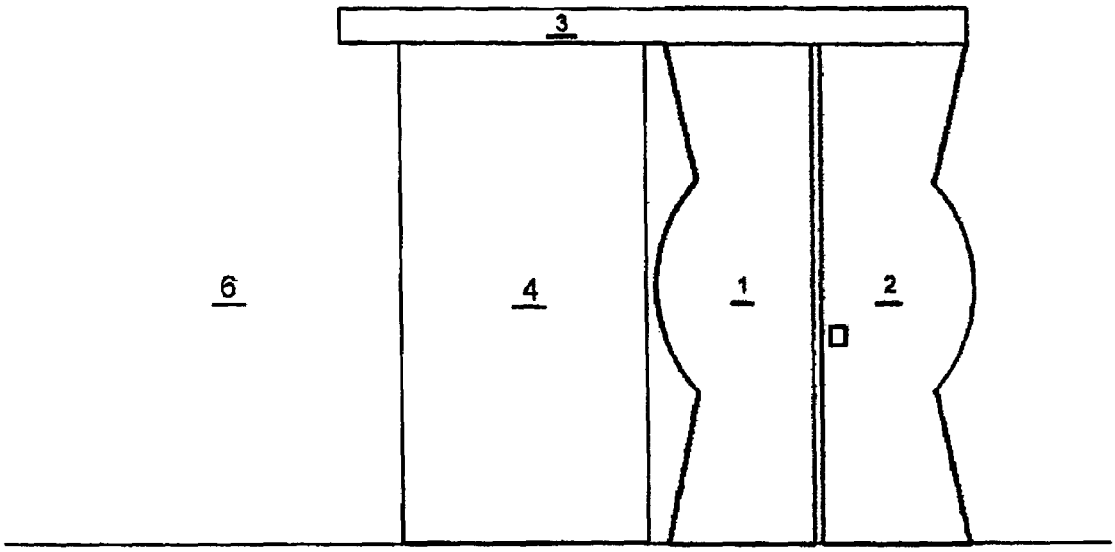
FIG. 9 is a front elevational view of the alternative embodiment shown in FIGS. 7 and 8.

As best shown in FIGS. 7-9, multiple alternative embodiments are within the scope of the invention. The alternative embodiments may include a locking system with the capability of locking and unlocking the top 16 and intermediate 20 rails with the stationary rail 22, so that the door panels 1, 2 maintain a position in which the first panel 1 abuts the second panel 2. The locking system may also lock and unlock the base unit 38 with an extended base unit 50. The locking system may further lock and unlock the extended base unit 50 with a wall support bracket 55. The actual mechanical locking of the components described above may be achieved by any method known in the art.

As best shown in FIGS. 7-9, in a first alternative embodiment, the primary base unit 38 includes at least one base lateral support 48 that connects the primary base unit 38 with an extended base unit 50. Similar to the configuration described above, the extended base unit 50 includes a roller track 52 that accommodates at least one roller 54 disposed at the end of the each base lateral support 48.

When the top 16 and intermediate rails are locked together with the stationary rail and the base unit is 38 unlocked from the extended base unit 50, the door panels 1, 2 may move in unison in the same direction. As the base lateral support rollers 54 travel in the extended base unit roller track 52, the primary base unit 38 and connected door panels 1, 2 move in unison and slide between positions in front of and away from the door opening 4, thereby effectively moving the door system between open and closed positions. FIG. 9 shows the alternate embodiment configurations of the door system in the open position.

In an additional alternative embodiment also best shown in FIGS. 7-9, the extended base unit 50 is slidingly mounted to a wall support bracket 55, which extends into a slot 56 in the extended base unit 50. When the wall support bracket 55 is unlocked from the extended base unit 50, and the extended base unit 50 is locked with the primary base unit 38, then the extended base unit 50, the primary base unit 38, and the connected door panels 1, 2 may move in unison and slide between positions in front of and away from a door opening 4, thereby effectively moving the door system between open and closed positions. Although a sliding rail connection is shown between the wall support bracket 55 and the extended base unit 50, other types of sliding connections, such as a roller assembly connection, should also be considered within the scope of the invention.

In a further alternative embodiment also shown in FIGS. 7-9, the extended base unit 50 may be unlocked from both the wall support bracket 55 and the primary base unit 38. In this configuration, the extended base unit 50, and the attached primary base unit 38 and door panels 1, 2, slide horizontally on the wall support bracket 55 (to the right in FIGS. 8 and 9) in unison away from the door opening 4. Once the extended base unit 50 and attached components reach the longitudinal end of the wall support bracket 55, the primary base unit 38 telescopes outwardly away from the extended base unit 50 to slide even further to the right as the base lateral support rollers 54 travel in the extended base unit roller track 52, as shown in FIG. 7 and as described above in a previous embodiment. The telescoping movement of the primary base unit 38 allows the primary base unit 38 and connected door panels 1, 2 to move even further away from the door opening 4 so that an enlarged door opening 4 may be completely uncovered and covered.

For the foregoing reasons, it is clear that the present invention provides an innovative door system. The preferred embodiment of the door system includes two door panels 1, 2 extending vertically from a telescoping door actuation mechanism A that simultaneously moves both door panels 1, 2 in opposite directions so that the door system moves between closed and open positions. The door panels 1, 2 are disposed in front of the door opening 4 rather than within the door opening 4 so that the size and shape of the door opening 4 does not limit the size and shape of the door panels 1, 2. The telescoping door actuating mechanism A does not rely on ceiling or floor-mounted tracks for smooth movement and vertical support. The actuating mechanism A is readily accessible for repair or for the replacement of the door panels 1, 2 if an occupant intends to redecorate a room.

The invention, as described, may be modified in multiple ways and applied in various technological applications. Although the invention is primarily directed to a door for a dwelling, the invention may also have application in other types of environments and technologies. Similarly, although the materials of construction are not described, they may include a variety of compositions consistent with the function of the invention. Such variations are not to be regarded as a departure from the spirit and scope of the invention, and all such modifications as would be obvious to one skilled in the art are intended to be included within the scope of the following claims.

I claim:

1. A sliding door system, comprising:

a telescoping door actuation mechanism extending above an opening in a wall, said actuation mechanism comprising:

at least top and intermediate rails, a gearing assembly rotatably attached to one of said rails so that moving one of said rails laterally in a first direction moves said gearing assembly laterally with respect to said wall and causes said rails to move in opposite directions, a first door panel attached to said top rail, and a second door panel attached to said intermediate rail, wherein said door panels are moved between an open and a closed position by moving one of said first and second door panels in an associated direction and thereby causing said gearing assembly to propel the other one of said door panels in an opposite direction.

2. The system of claim 1 wherein said actuation mechanism, comprises:

a first gear, a second gear extending from a center portion of said first gear, said second gear having a smaller diameter than said first gear, and a third gear meshing with said second gear so that rotating said third gear causes said first gear to rotate at a faster rate and in an opposite direction than said third gear, wherein said first, second, and third gears are connected to, and move laterally with said intermediate rail, and said top rail has gear teeth that mesh with said first gear so that moving said intermediate rail laterally causes said top rail to move laterally in a direction opposite said intermediate rail.

3. The system of claim 2 wherein said first gear and said third gear have a common diameter and said second gear has a diameter less than the diameters of said first and third gears so that said gearing assembly has a gearing ratio greater than 1:1.

4. The system of claim 3 wherein said gearing assembly has a gearing ratio of 2:1.

5. The system of claim 1, further comprising:

a first support assembly extending horizontally from a wall on a first side of the opening, said first support assembly engaging a bottom portion of said first door panel, a second support assembly extending horizontally from the wall on a second side of the opening, said second support assembly engaging a bottom portion of said second door panel, wherein said first and second support assemblies facilitate movement of said first and second door panels between said open and said closed positions by stabilizing and supporting said bottom portions of said first and second door panels.

6. The system of claim 5, wherein:

said first support assembly comprises at least a first roller extending horizontally from said wall on said first side of said opening, and, said second support assembly comprises at least a second roller extending horizontally from said wall on said second said of said opening, said door system further comprising:

a first roller track assembly positioned on a bottom portion of said first door panel, a second roller track assembly positioned on a bottom portion of said second door panel, wherein said first roller engages said first roller track assembly, and said second roller engages said second roller track assembly, so that said first and second rollers facilitate movement of said door system between said open and said closed positions.

7. The system of claim 6 wherein each of said first and second door panels have an exterior face facing in a direction of said wall and said opening, and each of said first and second door panels have an interior face facing in a direction away from said door and said door opening.

8. The system of claim 7 wherein each of said first and second door panels have a planar said interior and exterior face.

9. The system of claim 8 wherein each of said first and second door panels have a rectangular shape.

10. The system of claim 7 wherein each of said first and second door panels have a planar said exterior face and a non-planer said interior face.

11. The system of claim 7 wherein each of said first and second door panels have a non-rectangular shape.

12. The system of claim 7 wherein each of said first and said second door panels have non-planar said interior and said exterior face and a non-rectangular shape.

13. The system of claim 7 wherein each of said first and second door panels have non-planar said interior and said exterior faces and said first and said second door panels each have an inner edge that is essentially straight, and each of said door panels have outer edge that is not straight, wherein said inner edge of said first panel abuts said inner edge of said second panel when said door system is in said closed position.

14. The system of claim 13 wherein each of said first and said second interior door facings are one of concave or convex.

15. The system of claim 5 wherein:

said first support assembly comprises at least a first roller track assembly positioned on said wall on said first side of said opening, and, said second support assembly comprises at least a second roller track assembly positioned on said wall on said second side of said opening, said door system further comprising:

a first roller extending horizontally from a bottom portion of said first door panel, a second roller extending horizontally from a bottom portion of said second door panel, wherein said first roller track assembly engages said first roller and said second roller track assembly engages said second roller, so that said first and second rollers facilitate movement of said door system between said open and said closed positions.

16. The system of claim 1 further comprising:

at least one first roller assembly extending vertically from a bottom portion of said first door panel and engaging a roller track extending from a floor surface, at least one second roller assembly extending vertically from a bottom portion of said second door panel and engaging a roller track extending from said floor surface, wherein said first and second roller assemblies facilitate movement of said first and second door panels, and first and second roller assemblies vertically support said first and second panels.

17. The system of claim 1 further comprising:

at least one first roller assembly extending vertically from a bottom portion of said first door panel and engaging a horizontal floor surface, at least one second roller assembly extending vertically from a bottom portion of said second door panel and engaging said horizontal floor surface, wherein said first and second roller assemblies facilitate movement of said first and second door panels, and first and second roller assemblies vertically support said first and second panels.

18. A sliding door system comprising:

a door opening in a wall, a telescoping door actuation mechanism extending above said door opening, said actuation mechanism comprising:

at least top and intermediate rails, a gearing assembly having a 2:1 gear ratio that is rotatably attached to said intermediate rail so that moving said intermediate rail laterally in a first direction also moves said gearing assembly laterally and thereby causes said top rail to move in a direction opposite of said intermediate rail, a first non-rectangular door panel having a top portion attached to said top rail, a second non-rectangular door panel having a top portion attached to said intermediate rail, a first roller extending horizontally from said wall on a first side of said door opening, a second roller extending horizontally from said wall on a second side of said door opening, a first roller track assembly connected to a bottom portion of said first door panel, said first roller engaging said first roller track assembly to facilitate movement of said first door panel, a second roller track assembly connected to a bottom portion of said second door panel, said second roller engaging said second roller track assembly to facilitate movement of said second door panel, wherein said sliding door system is moved from a closed position to an open position by moving said first door panel in said first direction thereby causing said gearing assembly to propel said second door panel in an opposite direction so that said door system is moved to said open position and said door opening is uncovered.

19. A sliding interior door apparatus for a door opening in a wall comprising:

a telescoping door actuating mechanism extending above a door opening and being attached to an associated wall, wherein said actuating mechanism is comprised of first, second, and third elongated members, a first door panel having a top portion attached to said actuating mechanism, said first elongated member connected to said first door panel, a second door panel having a top portion attached to said actuating mechanism, said second elongated member connected to said second door panel, a gearing assembly rotatably interconnecting said first, second, and third elongated members so that moving said first elongated member laterally in a first direction moves said gearing assembly laterally and causes said second elongated member to move in a second opposite direction, a first roller assembly extending horizontally from said wall on a first side of said opening, a second roller assembly extending horizontally from said wall on a second side of said opening, a first roller track in a bottom portion of said first door panel, said first roller assembly engaging said first roller track to thereby facilitate the movement of said first door panel and to vertically support said first door panel, a second roller track in a bottom portion of said second panel, said second roller assembly engaging said second roller track to thereby facilitate the movement of said second door panel and to vertically support said second door panel, wherein said door system is moved from a closed position to an open position by applying a force to one of said first or said second door panels, when a force is applied to said first door panel then said first door panel moves in a first direction away from said second door panel so that said actuating mechanism telescopes in said first direction to allow said first door panel to slide away from a centerline of said door opening in said first direction, simultaneously said actuating mechanism telescopes in a direction opposite said first direction and propels said second door panel in said direction opposite said first door panel so that said door system is moved to said open position and said door opening is uncovered.

20. The apparatus as described in claim 19 wherein said door system is moved from said open position to said closed position by moving said first door panel in a direction opposite said first direction so that said actuating mechanism is compressed and said first door panel moves toward said second door panel, simultaneously said actuating mechanism propels said second door panel toward said first door panel so that said first door panel abuts said second door panel and said door opening is covered.

21. The apparatus as described in claim 20 wherein said actuating mechanism is further comprised of a primary base unit attached to said elongated members, said three elongated members are adapted to be positioned in a parallel arrangement.

22. The apparatus as described in claim 21 further comprising:

at least one upper lateral support extending between said primary base unit and said first elongated member, said upper lateral support having a roller mechanism disposed at a first distal end and connecting to said first elongated member at a second distal end, at least one intermediate lateral support extending between said primary base unit and said second elongated member, said intermediate lateral support having a roller mechanism disposed at a first distal end and connecting to said second elongated member at a second distal end, and at least two roller tracks extending longitudinally within said primary base unit, wherein said roller mechanisms for said upper and said intermediate lateral supports engage said primary base unit roller tracks so that said upper and intermediate roller mechanisms travel within said primary base unit roller tracks and facilitate movement of said first and second elongated members and provide vertical support for said door apparatus.

23. The apparatus as described in claim 22 wherein said primary base unit abuts and is connected to said wall.

24. The apparatus as described in claim 22 wherein said primary base unit is connected to an extended base unit by an extended base unit lateral support, said extended base unit lateral support having a first end connected to said primary base unit and a second end connected to a base roller mechanism, wherein said base roller mechanism engages an extended base unit roller track disposed within said extended base unit so that said primary base unit slides laterally when said extended base unit lateral roller mechanism travels in said extended base unit roller track thereby allowing said first and second panels attached to said primary base unit to move in a same direction and slide from a position in front of said door opening to a position on one side of said door opening.

25. The apparatus as described in claim 24 further comprising a locking system wherein said first and second elongated members are one of locked or unlocked with said third elongated member and said primary base unit is one of locked or unlocked with said extended base unit.

26. The apparatus as described in claim 24 wherein said extended base unit is attached to said wall.

27. The apparatus as described in claim 25 wherein said extended base unit is slidingly connected to a support bracket, said extended base unit sliding horizontally on said support thereby allowing said first and second panels, said primary base unit, and said extended base unit to move in a same direction and slide from a position in front of said door opening to a position on one side of said door opening.

28. The apparatus as described in claim 27 wherein said support bracket abuts and is connected to said wall.

29. The apparatus as described in 19 wherein said gearing assembly is comprised of a first gear, a second gear, and a third gear, said first and third gears having essentially a same diameter, and said second gear having a smaller diameter that said first and third gears.

30. The apparatus as described in claim 29 wherein said first, second, and third gears are arranged so that said gearing assembly has a 2:1 gear ratio.

31. The apparatus as described in claim 19 further comprising an actuating mechanism cover wherein said actuating mechanism cover expands and retracts as said actuating mechanism telescopes between said closed and said open positions so that said actuating mechanism is continuously covered.

32. A sliding door system, comprising:

first and second door panels laterally slidable in opposite directions to one another between open and closed positions relative to an opening in a wall;

a door actuation mechanism extending above the opening in the wall, said actuation mechanism comprising:

first and second rails attached to the first and second door panels, respectively; and a gearing assembly comprising a rotatable first gear cooperating with the first door panel so as to slide along with the first door panel between the open and closed positions, said gearing assembly further comprising a second gear cooperating with the rotatable first gear to cause the second door panel to move in opposite direction to the first door panel between the open and closed positions.

wherein said door panels are moved between an open and a closed position by moving one of said first and second door panels in an associated direction and thereby causing said gearing assembly to propel the other one of said door panels in an opposite direction.

* * * * *